US007228813B2

(12) United States Patent
Flamingo et al.

(10) Patent No.: US 7,228,813 B2
(45) Date of Patent: Jun. 12, 2007

(54) TRAFFIC CONE SYSTEM

(76) Inventors: Angelo Lamar Flamingo, 1089 Westport Dr., #151, Port Washington, WI (US) 53074; James Gregory Whitfield, II, 109 Post Oak Path, Unit 77, Lexington, KY (US) 40509; Todd Alan Thiel, 7775 Cincinnati Rd., Sadieville, KY (US) 40370

( * ) Notice: Subject to any disclaimer, the term of this patent is extended or adjusted under 35 U.S.C. 154(b) by 0 days.

(21) Appl. No.: 11/184,116

(22) Filed: Jul. 19, 2005

(65) Prior Publication Data

US 2006/0016383 A1 Jan. 26, 2006

Related U.S. Application Data

(60) Provisional application No. 60/591,030, filed on Jul. 26, 2004.

(51) Int. Cl.
*E01F 9/012* (2006.01)

(52) U.S. Cl. ..... 116/63 C; 116/63 R; 116/63 P; 40/610

(58) Field of Classification Search ..... 116/63 C, 116/63 R, 28 R, 63 P; 40/610
See application file for complete search history.

(56) References Cited

U.S. PATENT DOCUMENTS

| | | | |
|---|---|---|---|
| 536,445 | A | 3/1895 | Rockwell |
| 1,560,938 | A | 11/1925 | Lund |
| 1,562,196 | A | 11/1925 | Abrams |
| 1,726,817 | A | 9/1929 | Franklin |
| 1,800,459 | A | 4/1931 | Maclean |
| 2,002,756 | A | 5/1935 | Segelhorst |
| 2,275,711 | A | 3/1942 | Ybanez |
| 2,333,273 | A | 11/1943 | Scanlon |
| 2,613,463 | A | 10/1952 | Transue |
| 2,646,638 | A | 7/1953 | Peterson |
| 2,762,328 | A | 9/1956 | Weig |
| 2,806,131 | A | 9/1957 | Palmer |
| 2,817,308 | A | 12/1957 | Scanlon |
| 2,882,170 | A | 4/1959 | Stewart |
| 2,887,983 | A | 5/1959 | Budd |
| 2,942,571 | A | 6/1960 | White |
| 2,954,005 | A | 9/1960 | Cioffi |
| 2,957,444 | A | 10/1960 | Boettler |
| 3,016,035 | A | 1/1962 | Asbury |
| 3,099,244 | A | 7/1963 | Knapp |
| 3,132,624 | A | 5/1964 | Shoemaker |
| 3,228,555 | A | 1/1966 | Pinto |
| 3,243,081 | A | 3/1966 | Schmank |
| 3,247,823 | A | 4/1966 | Buck et al. |

(Continued)

FOREIGN PATENT DOCUMENTS

| | | | |
|---|---|---|---|
| DE | 3524084 | A1 | 5/1985 |

(Continued)

*Primary Examiner*—Richard Smith
*Assistant Examiner*—Tania Courson

(57) ABSTRACT

A traffic cone system includes a base, a sleeve, and a retainer. The retainer substantially secures the sleeve relative to the base. A member such as a spring may be inserted into the sleeve make the sleeve stand upright. The member may act in concert with the retainer to secure the sleeve relative to the base. The system may be used to refurbish damaged traffic cones or may otherwise be retrofitted to existing traffic cone components. The system may alternatively be used to build new cones.

2 Claims, 15 Drawing Sheets

U.S. PATENT DOCUMENTS

| | | | | |
|---|---|---|---|---|
| 3,378,183 | A | | 4/1968 | Ferrer |
| 3,380,428 | A | | 4/1968 | Arams |
| 3,386,409 | A | | 6/1968 | Dawson |
| 3,436,163 | A | | 4/1969 | Calabrese |
| 3,451,368 | A | | 6/1969 | Keats |
| 3,464,590 | A | | 9/1969 | Giannettino |
| 3,478,715 | A | | 11/1969 | Asbury |
| 3,496,904 | A | | 2/1970 | Rimkus |
| 3,499,413 | A | | 3/1970 | Heard |
| 3,520,235 | A | | 7/1970 | Palazzolo et al. |
| 3,618,556 | A | | 11/1971 | Dietrich |
| 3,633,161 | A | | 1/1972 | Price |
| 3,707,320 | A | | 12/1972 | Brynes |
| 3,732,842 | A | | 5/1973 | Vara |
| 3,788,268 | A | | 1/1974 | Hiatt |
| 3,809,007 | A | | 5/1974 | Brown |
| 3,851,616 | A | | 12/1974 | Brown |
| D235,746 | S | | 7/1975 | Clarke |
| 3,949,701 | A | | 4/1976 | Teixeira |
| 4,006,702 | A | | 2/1977 | St. Cyr |
| 4,083,033 | A | | 4/1978 | Kulp |
| 4,087,021 | A | | 5/1978 | Cotugno |
| 4,119,243 | A | | 10/1978 | Marecek |
| 4,197,807 | A | | 4/1980 | Campbell |
| 4,219,141 | A | | 8/1980 | Lovy |
| 4,256,050 | A | | 3/1981 | Barnard |
| 4,300,684 | A | | 11/1981 | Smith |
| 4,466,376 | A | | 8/1984 | Wells |
| 4,552,089 | A | | 11/1985 | Mahoney |
| 4,571,118 | A | | 2/1986 | Schmanski |
| 4,597,706 | A | | 7/1986 | Michit |
| 4,747,515 | A | | 5/1988 | Kasher |
| 4,752,146 | A | | 6/1988 | Buckle |
| 4,798,747 | A | | 1/1989 | Laramee |
| 4,848,263 | A | | 7/1989 | Grimm |
| 4,889,067 | A | | 12/1989 | Provence |
| 4,925,334 | A | | 5/1990 | Beard |
| 4,967,930 | A | | 11/1990 | Koltze |
| 4,979,461 | A | | 12/1990 | Provence, Jr. |
| 5,054,648 | A | | 10/1991 | Luoma |
| 5,090,349 | A | | 2/1992 | Wilson |
| 5,199,813 | A | * | 4/1993 | Nagler ..... 404/9 |
| 5,213,464 | A | | 5/1993 | Nicholson |
| 5,244,334 | A | | 9/1993 | Akita |
| 5,287,822 | A | | 2/1994 | Anderson |
| 5,305,705 | A | | 4/1994 | Gagliano |
| 5,375,554 | A | | 12/1994 | Yen |
| 5,421,668 | A | | 6/1995 | Cowan et al. |
| 5,439,311 | A | | 8/1995 | Hughes, Jr. |
| 5,451,118 | A | | 9/1995 | Wilkins |
| 5,488,792 | A | | 2/1996 | Kwok |
| 5,525,021 | A | | 6/1996 | Larguier |
| 5,560,732 | A | * | 10/1996 | Kulp et al. ..... 404/10 |
| 5,888,016 | A | | 3/1999 | Ahn |
| 5,944,220 | A | | 8/1999 | Garske |
| 5,993,105 | A | | 11/1999 | Chan |
| 6,053,657 | A | | 4/2000 | Signorelli |
| 6,056,498 | A | | 5/2000 | Velinsky |
| 6,119,621 | A | | 9/2000 | Johnson |
| 6,199,504 | B1 | * | 3/2001 | Freeman ..... 116/63 C |
| 6,247,424 | B1 | | 6/2001 | Huang |
| 6,499,858 | B2 | | 12/2002 | Hart |
| D472,490 | S | | 4/2003 | Perelli |
| 6,752,582 | B2 | | 6/2004 | Garcia |
| 6,766,760 | B2 | | 7/2004 | Garcia |
| 6,928,952 | B2 | * | 8/2005 | Garcia ..... 116/63 C |
| 7,007,420 | B2 | * | 3/2006 | Garcia ..... 40/610 |
| 7,056,055 | B1 | * | 6/2006 | Kuo ..... 404/9 |
| 2003/0136329 | A1 | * | 7/2003 | Garcia ..... 116/63 C |
| 2004/0237875 | A1 | * | 12/2004 | Garcia ..... 116/63 C |
| 2005/0076822 | A1 | * | 4/2005 | Levine ..... 116/63 C |

FOREIGN PATENT DOCUMENTS

| | | |
|---|---|---|
| DE | 3940007 A1 | 2/1989 |
| FR | 2618245 | 7/1987 |

* cited by examiner

TRAFFIC CONE SYSTEM

PRIORITY

This application claims priority from the disclosure of U.S. Provisional patent application Ser. No. 60/591,030, entitled "Standard Plastic To Flexible Cone Conversion/Refurbish," filed Jul. 26, 2004.

BACKGROUND

Embodiments of the present invention relate to traffic cones and similar devices. A variety of types of traffic cones have been created, and the components of existing traffic cones have been modified in various ways. However, no one prior to the inventors has created or used the invention described in the appended claims.

BRIEF DESCRIPTION OF THE DRAWINGS

While the specification concludes with claims that particularly point out and distinctly claim the invention, it is believed the present invention will be better understood from the following description taken in conjunction with the accompanying drawings, in which like reference numerals identify the same elements. The drawings and detailed description which follow are intended to be merely illustrative and are not intended to limit the scope of the invention as set forth in the appended claims.

DETAILED DESCRIPTION

The following description should not be used to limit the scope of the present invention. Other examples, features, aspects, embodiments, and advantages of the invention will become apparent to those skilled in the art from the following description, which includes by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive. It should therefore be understood that the inventors contemplate a variety of embodiments that are not explicitly disclosed herein.

Figure 1:
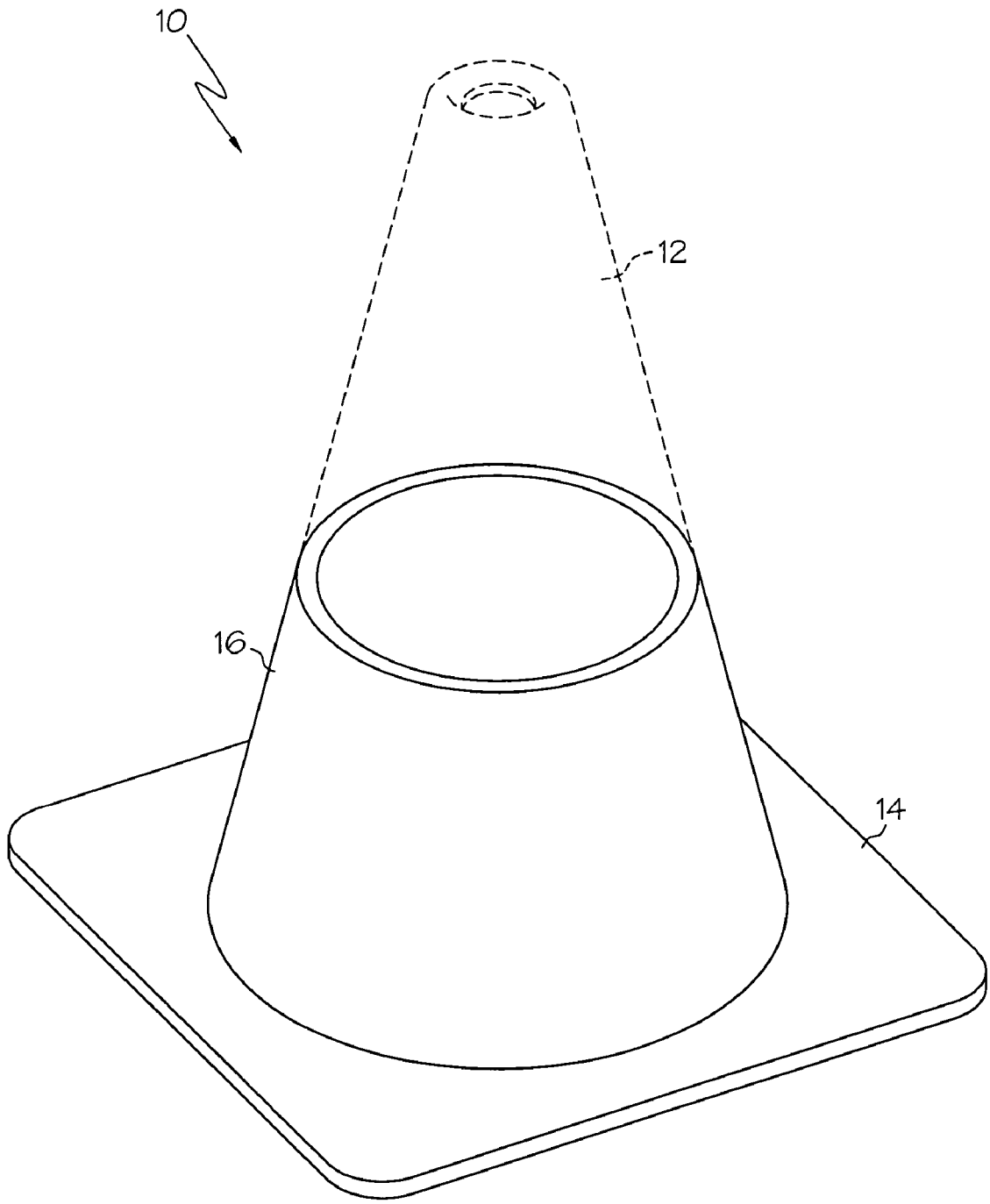
FIG. 1 depicts a perspective view of a traffic cone having a portion of its integral cone portion removed.
Figure 2:
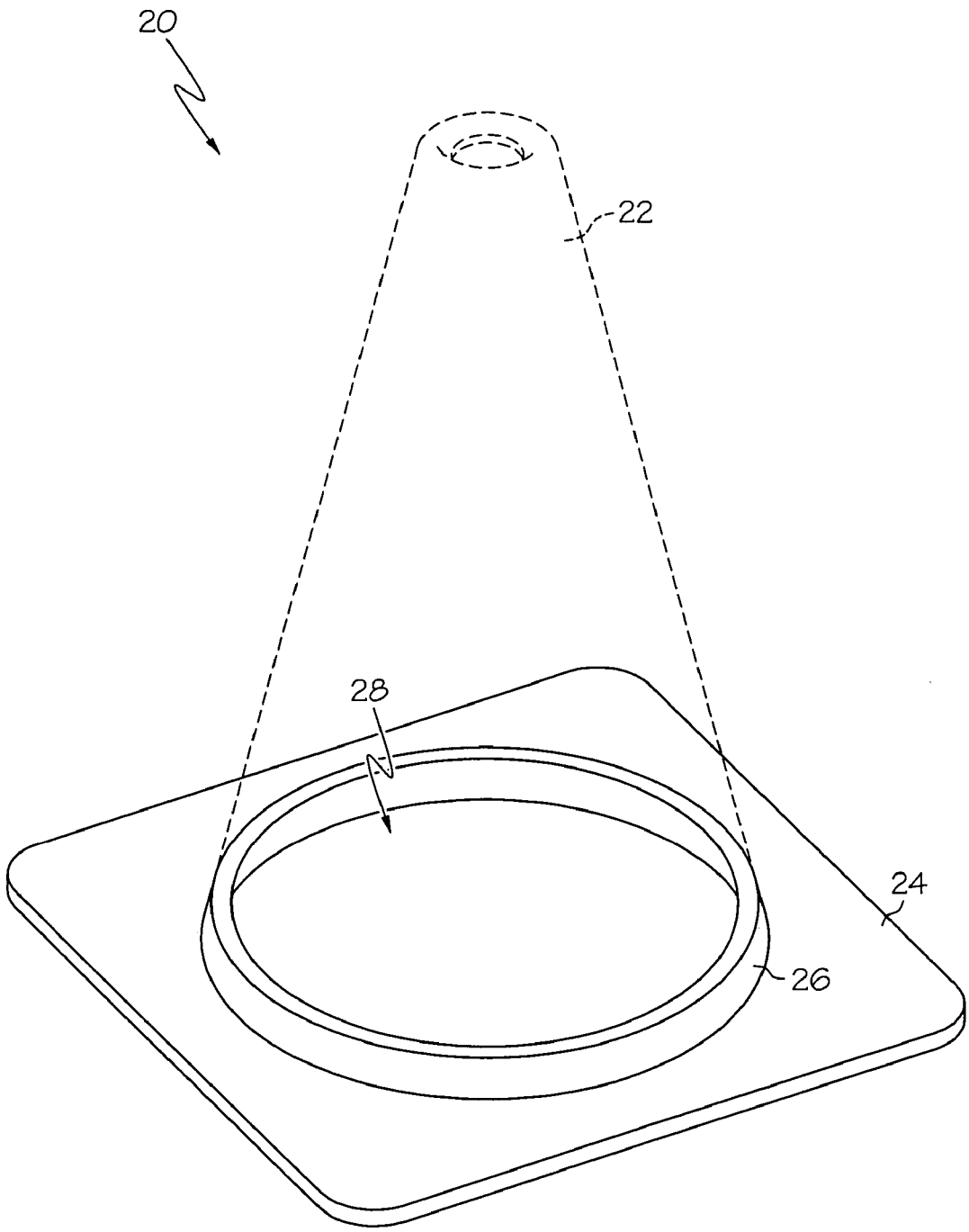
FIG. 2 depicts a perspective view of a traffic cone having a substantial portion of its integral cone portion removed.

FIGS. 1 and 2 depict traffic cones (10, 20, respectively) having top cone portions (12, 22) removed. Cones (10, 20) thus each comprise a base (14, 24) and a remaining cone portion (16, 26). Each base (14, 24) has a center opening (28). As shown, cone portion (16) in FIG. 1 is substantially larger than cone portion (26) in FIG. 2. For instance, cone portion (26) may rise approximately ⅛" from the top of base (24). In one embodiment, the top portion (12, 22) of each of these cones (10, 20) has been damaged, and has therefore been removed. For instance, the top portion (12, 22) may have been torn, deformed, had reflective material wear off, or have any other undesirable feature or property. Of course, each top portion (12, 22) may have been cut away and recycled or otherwise disposed of for a variety of other reasons. Alternatively, cones (10, 20) may have had nothing removed.

Figure 3:
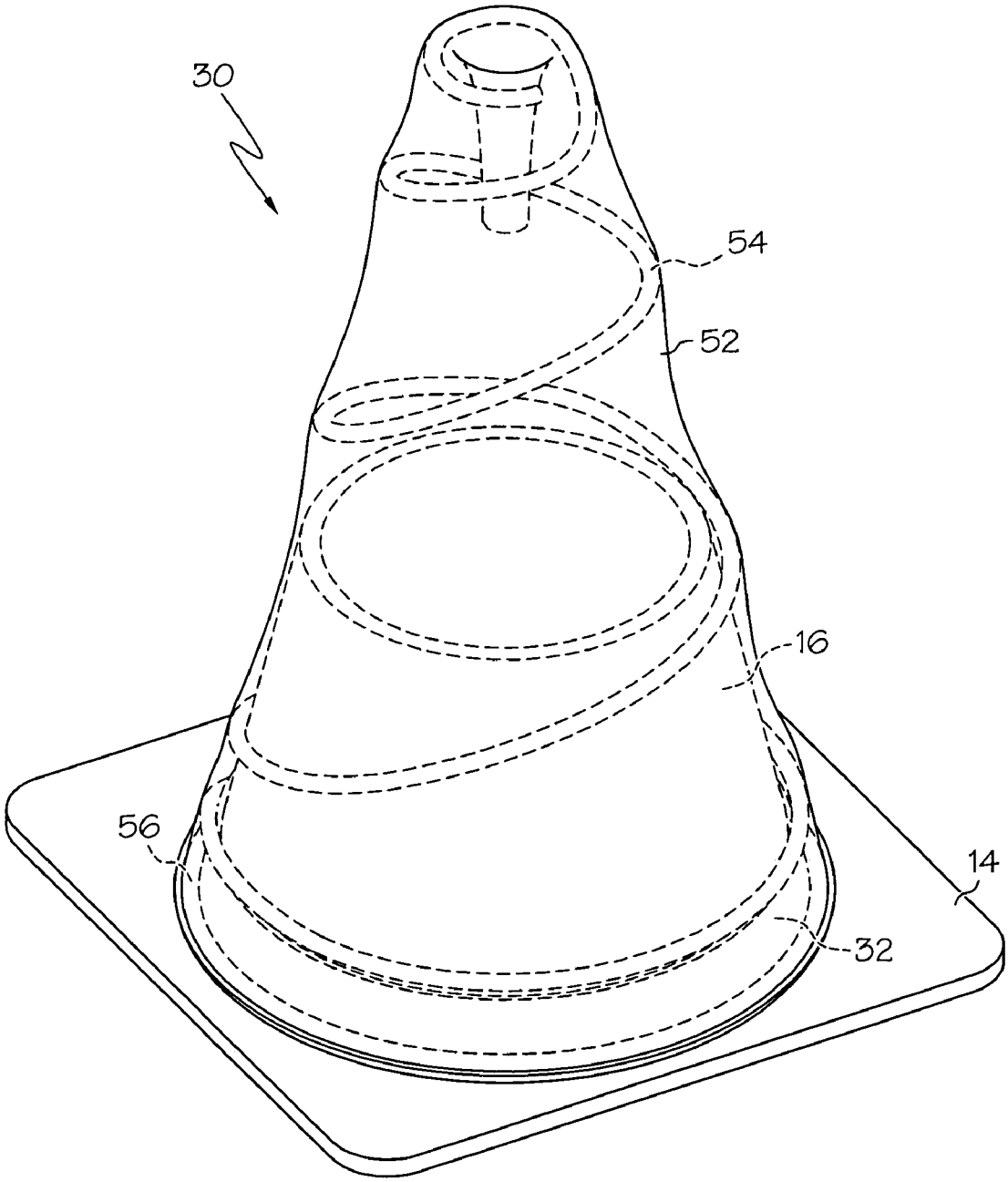
FIG. 3 depicts a perspective view of the traffic cone of FIG. 1 with a sleeve conversion.
Figure 4:
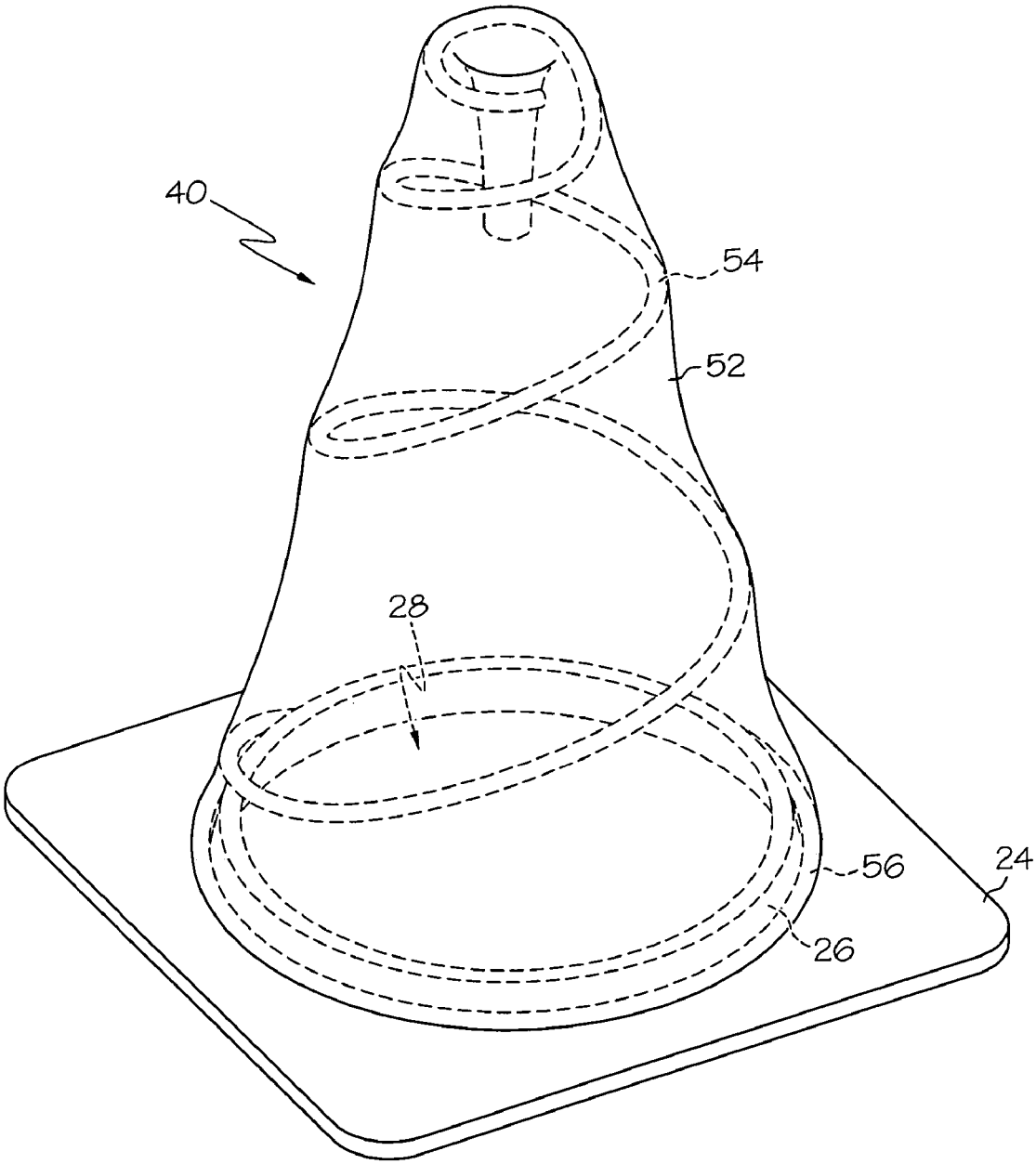
FIG. 4 depicts a perspective view of the traffic cone of FIG. 2 with a sleeve conversion.

FIGS. 3 and 4 each show a sleeve conversion (30, 40) placed over the cone portions (16, 26). Each sleeve conversion (30, 40) comprises a sleeve (52) and a spring (54). Sleeve (52) of the present example is formed of a substantially flexible material. By way of example only, sleeve (52) may be formed of cloth, plastic, mesh, or any other material, or combinations thereof. It will be appreciated that any other material or combination of materials may be used. Sleeve (52) may also be of any color or combination of colors. For instance, in the present example, sleeve (52) is orange. Of course any other color or color combinations may be used. Other visual features may be added to sleeve (52), including but not limited to reflective strips or reflective material, printed material, and the like. For instance, sleeve (52) may include printed material comprising any one of advertisements, warnings, directions, decorations, and the like. In addition, sleeve (52) of the present example has a mesh-like structural configuration, similar to a net, and provides a generally conical shape. However, it will be appreciated that sleeve (52) may have any other structural configuration. For instance, sleeve (52) may have an ornamental design, including but not limited to that of a sport ball (e.g., football, baseball, etc.), or one representative of a holiday (e.g., Halloween, Thanksgiving, Christmas, Easter, etc.). When constructed of a mesh or net-like material, sleeve (52) may demonstrate a reduced susceptibility to wind. Alternatively, such a material may provide other results, and/or demonstrate no effect relative to wind susceptibility. Still other features and variations for sleeve (52) will be apparent to those of ordinary skill in the art.

As shown, spring (54) is positioned within sleeve (52). Spring (54) is biased to expand upward and outward, thereby expanding sleeve (52) to take the form of a cone. While the present example includes a cone-shaped sleeve conversion (30, 40), it will be appreciated that any other shape may be used. It will also be appreciated that the shape may be influenced by the shape or other properties of the spring (54), the shape or other properties of the sleeve (52), and/or any other component. The spring (54) of the present example is a standard coil spring, and may be compressed by a downwardly applied force to collapse the spring (54) and the sleeve (52). Of course, any number of springs (54) or suitable alternatives to spring (54) may be used. For instance, any other resilient member may be used, examples of which will be apparent to those of ordinary skill in the art. In another embodiment, spring (54) is substituted with one or more substantially rigid members. In addition, while spring (54) is shown as being positioned within sleeve (52), it will be appreciated that spring (54) may be positioned outside sleeve (52). For instance, sleeve (52) may be substantially secured to an external spring with one or more fasteners. Alternatively, a spring (54) or other member or members may be interwoven with sleeve (52) or at least partially contained by an external pocket of sleeve (52). Still other variations will be apparent to those of ordinary skill in the art.

In one embodiment, the sleeve (52) is secured relative to the base (24), and then the spring (54) is inserted through the opening (28) in the base (24) and allowed to expand within sleeve (52). In another embodiment, the spring (54) is inserted into sleeve (52) prior to the sleeve (52) being secured relative to base. By way of example only, the diameter of one or more coils of spring (54) may need to be at least temporarily reduced in order for spring to pass through opening (28). In one embodiment, such diameter reduction is effected by rotating spring (54) during the act of inserting spring (54). Of course, any variations of these acts may be employed. It will also be appreciated that spring (54) need not be secured to base (24) or sleeve (52), or any other component. Alternatively, spring (54) may be secured to base (24), sleeve (52) or any other component.

Figure 5:
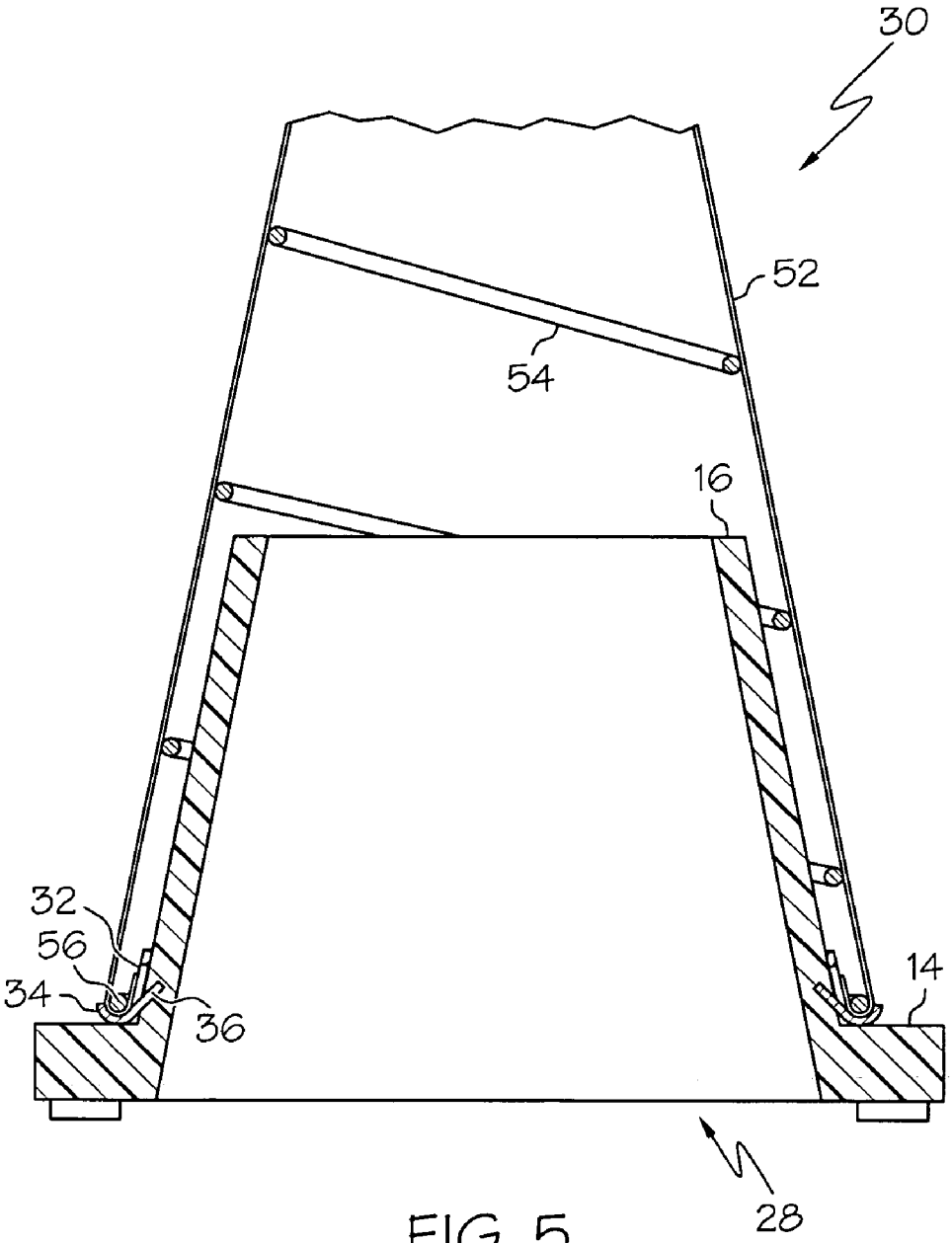
FIG. 5 depicts a cross-sectional view of the cone system of FIG. 3.

As shown in FIGS. 3 and 5, sleeve conversion (30) further comprises a retainer member (32). The retainer member (32) has an outer rim (34) and a plurality of inwardly projecting teeth (36). The sleeve (52) is positioned between the bottom coil (56) of spring (54) and retainer member (32). The sleeve (52) is held in place with respect to the retainer member (32), adjacent to the outer rim (34), by friction induced in response to forces exerted by the bottom coil (56) of spring (54) against the outer rim (34). Alternatively, sleeve (52) may be substantially secured to the retainer member (32) with an adhesive, staples, other fasteners, or using any other technique. The teeth (36) of retainer member (32) are configured to engage the cone portion (16), thereby securing the sleeve conversion (30) relative to the cone portion (16).

Figure 6:
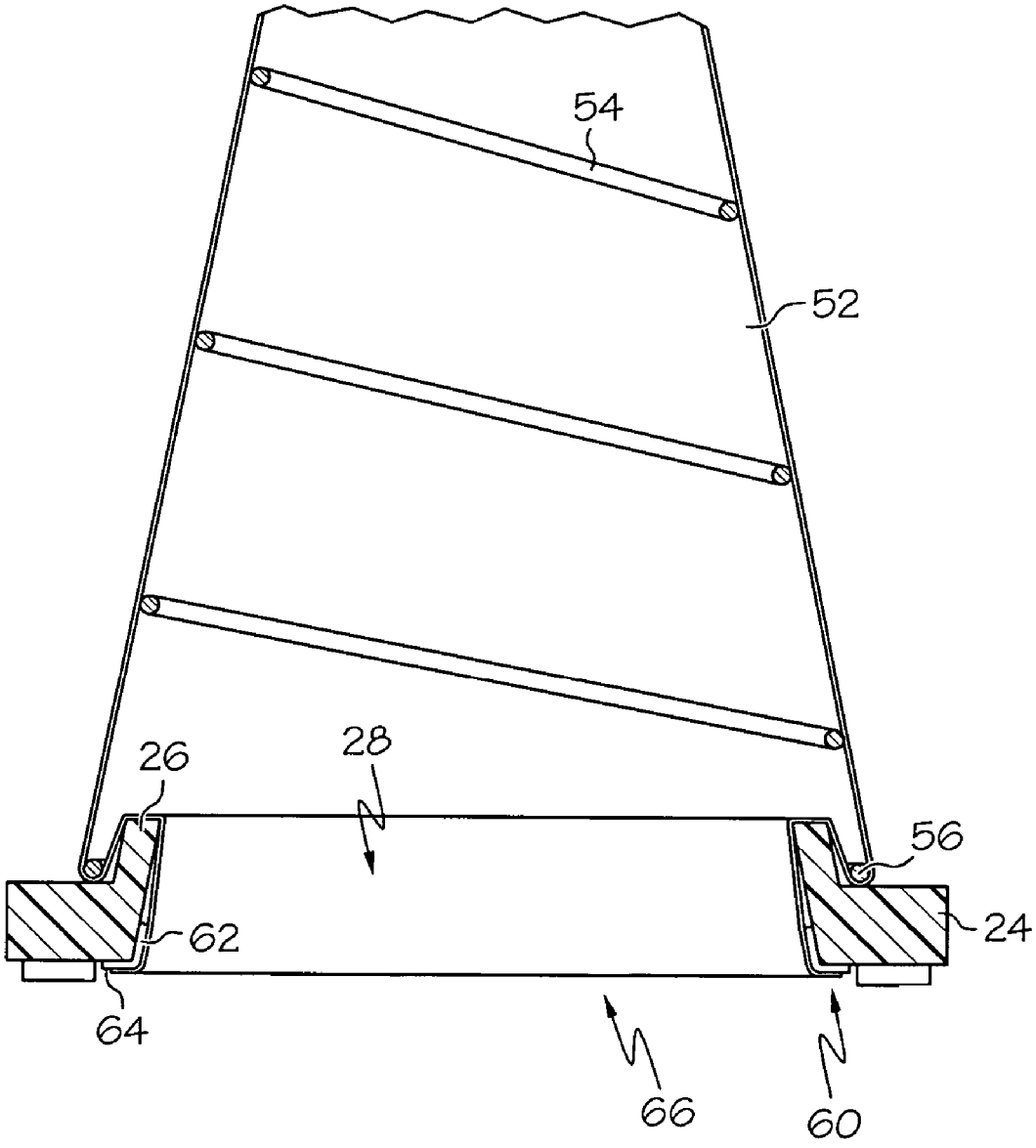
FIG. 6 depicts a cross-sectional view of the cone system of FIG. 4.
Figure 7:
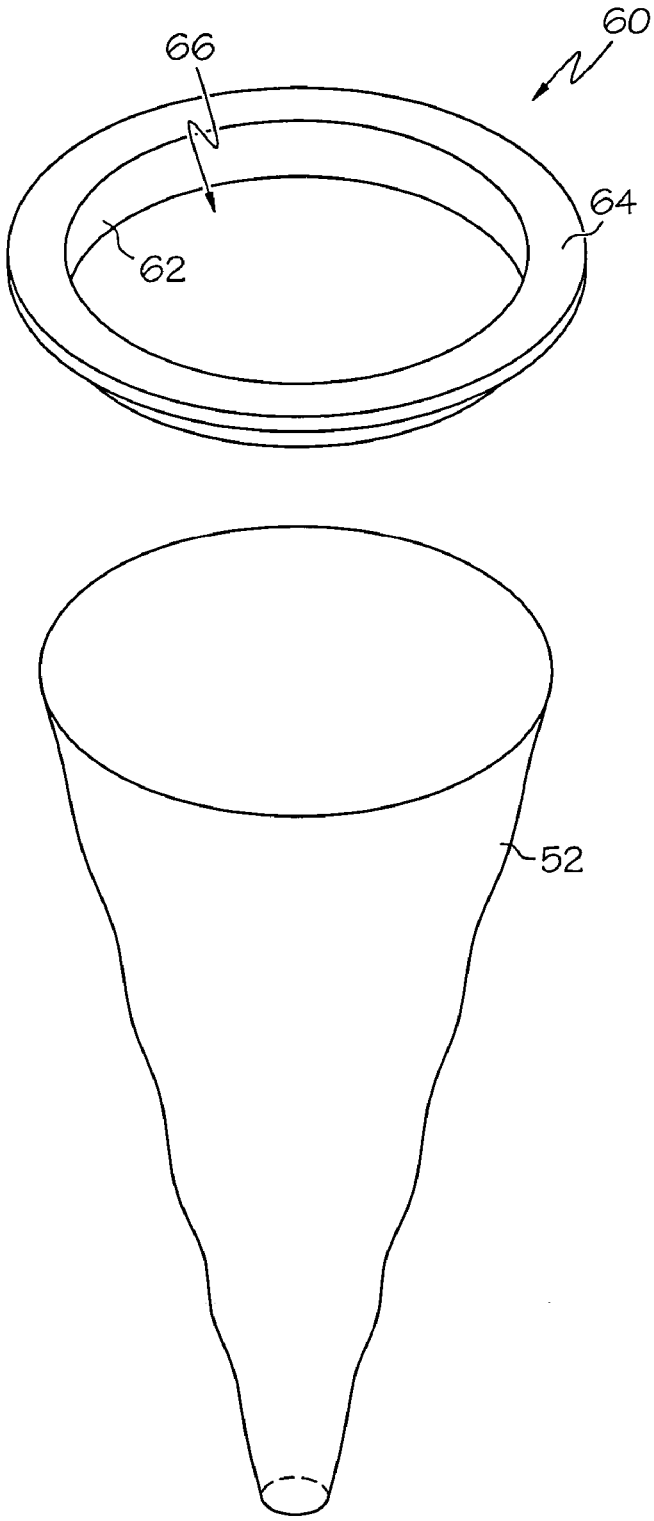
FIG. 7 depicts a perspective view of sleeve conversion components.
Figure 8:
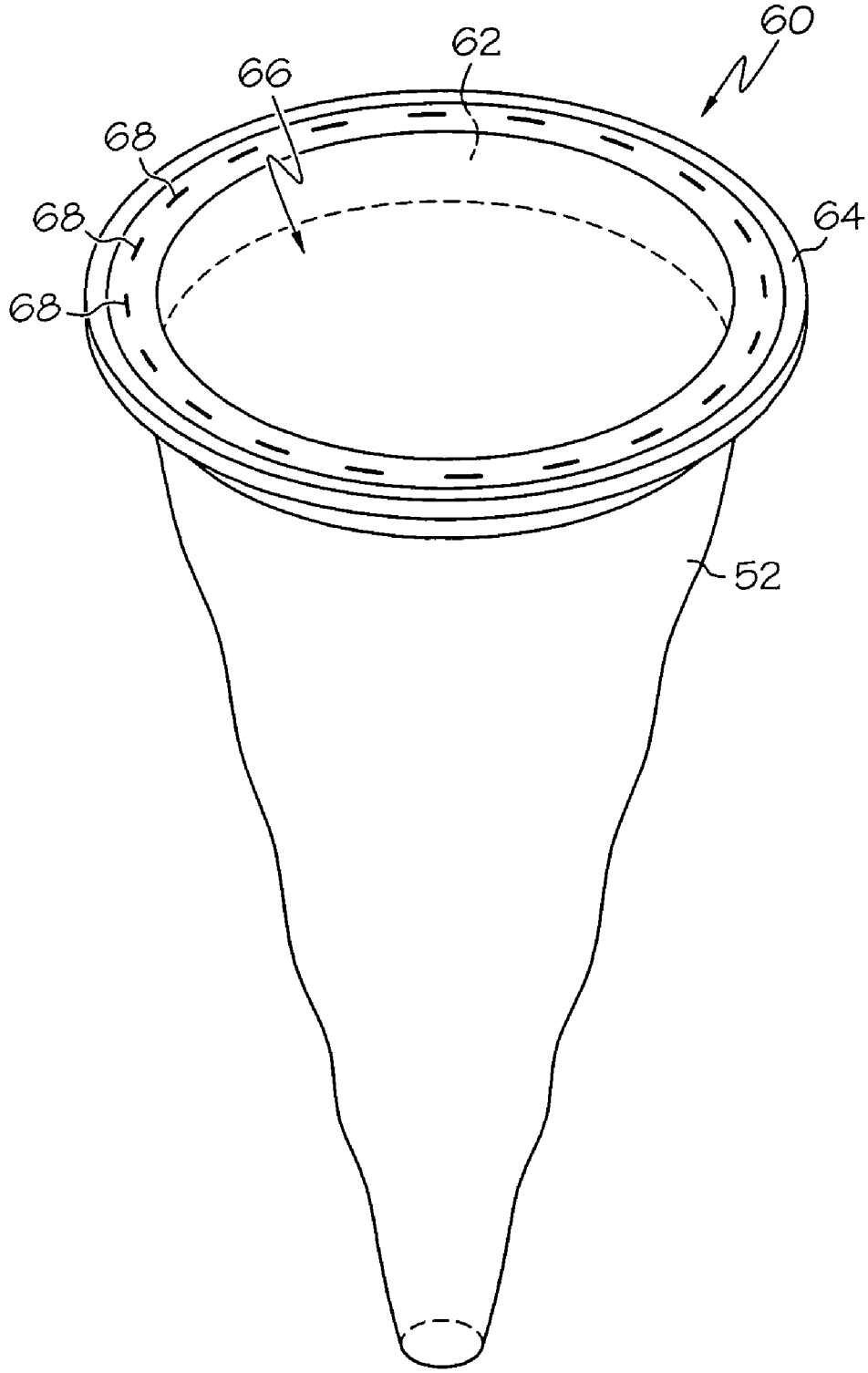
FIG. 8 depicts a perspective view of the components of FIG. 7 secured together.
Figure 9:
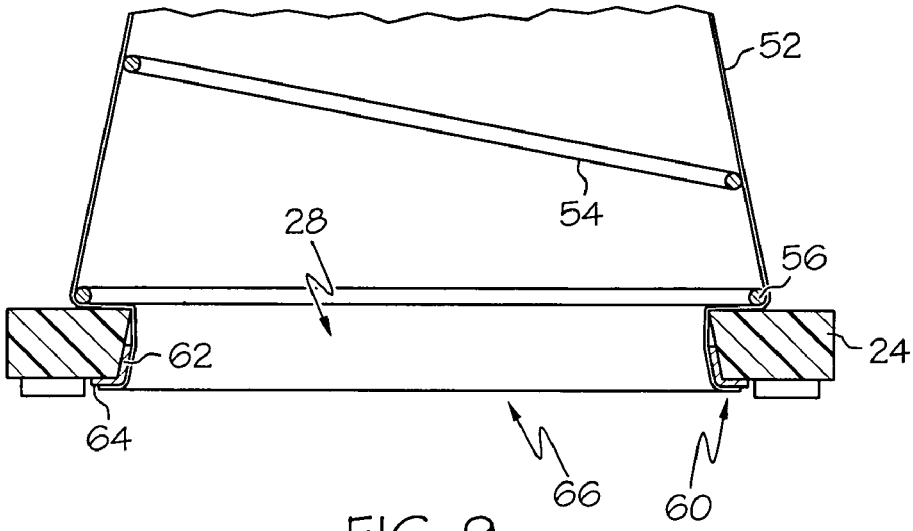
FIG. 9 depicts a cross-sectional view of a cone system lacking an integral cone portion.

FIGS. 7 and 8 represent a series of exemplary steps for preparing portions of the sleeve conversion (40) that is shown in FIGS. 4, 6, and 9. FIG. 7 shows a retainer (60) and a sleeve (52) separated. Retainer (60) of this example comprises an axial flange (62) and a radial flange (64), which are substantially perpendicular to each other and integrally formed. Of course, axial flange (62) and radial flange (64) may have any other suitable angular relationship, and may be formed in any suitable way. Axial flange (62) and radial flange (64) define an opening (66) about the center of retainer (60). While retainer (60) of the present example is formed of rubber, it will be appreciated that retainer (60) may be formed of any other material, including but not limited to plastic or metal or combinations thereof. A variety of alternative materials and configurations for retainer (60) will be apparent to those of ordinary skill in the art.

As shown in FIG. 8, sleeve (52) is inserted through the opening (66) of retainer (60), and is secured to the radial flange (64) by a plurality of staples (68). Alternatively, sleeve (52) may be substantially secured to retainer (60) by adhesives, fasteners (e.g., tacks, clips, clamps, etc.), or using any other technique.

FIGS. 4, 6, and 9 show the sleeve conversion (40) comprising sleeve (52), retainer (60), and spring (54) engaged with base (24). As shown, retainer (60) is dimensioned such that axial flange (62) will fit within the center opening (28) of base (24). Such a fit may be an interference fit, a loose fit, or any other type of fit. The retainer (60) of the present example is also dimensioned such that the outer perimeter of radial flange (64) has a diameter that is greater than the diameter of the opening (28) in base (24). It will be appreciated that, with sleeve (52) secured to retainer (60), and with retainer (60) engaged with base (24) as shown in FIG. 9, retainer (60) may substantially restrict upward movement of sleeve (52) relative to base (24). It will also be appreciated that, with spring (54) positioned within sleeve (52) as shown in FIG. 9, spring (54) may substantially restrict downward movement of sleeve (52), at least in the absence of an external downward force acting upon spring (54). In other words, spring (54) may cause sleeve (52) to maintain a substantially conical shape; but sleeve (52) and spring (54) may be collapsed in response to a downward force to reach a substantially flattened configuration. Such collapsing may be useful for storage and/or dispensing of cones using sleeve (52), by way of example only.

In the foregoing and following examples, it will also be appreciated that sleeve (52) may restrict upward movement of spring (54) relative to base (24). For instance, the conical shape of the sleeve (52) of the present example may prevent the spring (54) from being released through the top of sleeve (52). In addition, in several embodiments, spring (54) need not be secured to base (24) with screws or similar devices. Alternatively, other devices such as screws may be used to secure spring (54) relative to base (24). It will also be appreciated that a variety of devices may be used to restrict downward movement of spring (54) relative to base (24). For instance, the top of base (24) may be used to restrict downward movement of spring (54) relative to base (24). By way of example only, where base (24) has a center opening (28), the diameter of the bottom coil (56) of spring (54) may be greater than the diameter of opening (28). Alternatively, a retainer, such as one of the many exemplary retainers described herein, may be used to restrict downward movement of spring (54) relative to base (24). In yet another embodiment, sleeve (52) restricts downward movement of spring (54) relative to base (24). It will be appreciated that this may be accomplished even without securing spring (54) to sleeve (52) (e.g. such as by cinching sleeve (52) as described below or using other techniques). It will also be appreciated that spring (54) may create expanding forces within sleeve (52). Still other ways in which spring (54) may interact with other components will be apparent to those of ordinary skill in the art.

It will be apparent to those of ordinary skill in the art that various embodiments of retainers described herein may, alone or in combination with other components, provide a clamping force to secure sleeve (52) relative to base (24). For instance, any of the various retainers may act in concert with spring (54) to secure sleeve (52) relative to base (24) or otherwise restrain sleeve (52). By way of example only, an outwardly biased internal spring (54) may provide a clamping effect in concert with an external retainer member. Of course, forces other than clamping forces may be provided and/or employed.

The base (24) shown in FIG. 9 is substantially similar to the base (24) shown in FIGS. 1–6, except that there is no cone portion (16, 26). In one embodiment, a prior cone portion has been removed from the base (24) of FIG. 9 in its entirety before sleeve conversion (40) is introduced to base (24), such that sleeve conversion (40) acts as a replacement for the prior cone. In other words, in this embodiment, sleeve conversion (40) is used as a retrofit or refurbishment. In another embodiment, the base (24) is formed alone, and sleeve conversion (40) is added to provide a first cone. In other words, in this embodiment, base (24) never had a prior cone, such that sleeve conversion (40) is used as an original cone and not a refurbishment. Accordingly, while the term "conversion" is used herein to describe various sleeve conversions, that term should not be read to require the replacement of a prior cone. For instance, any of the various sleeve conversions described herein may be used to "convert" a base (24), which never had a prior cone portion, into a traffic cone or other device. Still other uses for various sleeve conversions described herein will be apparent to those of ordinary skill in the art.

In one embodiment, base (24) comprises a PVC material. In another embodiment, base (24) comprises rubber. In yet another embodiment, base (24) comprises material recycled from cone weights. Of course, any other material or combination of materials may be used to form base (24). Base (24) may also include one or more weights or other features not explicitly illustrated in the drawings. For instance, base (24) may include one or more light sources of any color. Such a light source may be configured to turn on and off in any sequence or timing. Still other variations for base (24) will be apparent to those of ordinary skill in the art.

The following embodiments, as shown, are similar to the embodiment shown in FIG. 9 in that they all include a base (24) lacking an original cone portion. Accordingly, the bases (24) depicted in FIGS. 10–11, 12B–15, and 17–28 may have had a prior cone portion removed, or may have never had a prior cone portion at all. However, it will also be appreciated that all of the following embodiments, including variations thereof, may also be used where at least some cone portion remains integral with or secured to the base (24), including but not limited to cone portions (16, 26) such as those shown in FIGS. 1–6. In addition, it will be appreciated that the following embodiments illustrate various ways in which a sleeve (52) or similar member may be substantially secured relative to a base (24) or similar member. Accordingly, the above description of sleeve (52) details, variations and functions, as well as the above description of spring (56) details, variations, and functions, also apply to the following embodiments. In addition, it will be appreciated that the base (24) depicted and discussed herein is merely exemplary, and that embodiments discussed herein, including variations, may be used with a variety of variations and alternatives to base (24). Furthermore, it will be appreciated that the foregoing and following embodiments, including variations, may provide a cone formed of a sleeve (52) and/or a spring (54), secured relative to a base (24) without the need for screws or similar hardware to effect such securing.

Figure 10:
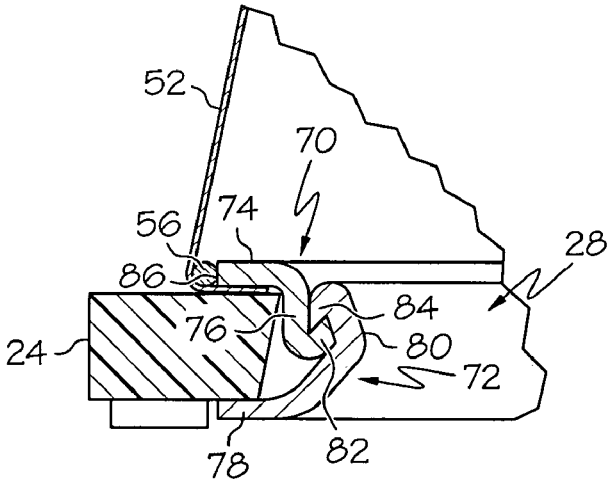
FIG. 10 depicts a partial cross-sectional view of a cone system having a pair of retainers securing a sleeve relative to a base.

FIG. 10 shows an upper retainer member (70) and a lower retainer member (72). Upper retainer member (70) has a radial flange (74) and a generally axial flange (76). Similarly, lower retainer member (72) has a radial flange (78) and a generally axial flange (80). Each generally axial flange (76, 80) terminates in a respective annular hook (82, 84). The annular hooks (82, 84) are configured to engage with one another. The sleeve (52) is secured to radial flange (74) of upper retainer member (70). Sleeve (52) may be substantially secured to upper retainer member (70) using, by way of example only, adhesives, fasteners, and the like. Of course, sleeve (52) may be substantially secured elsewhere to upper retainer member (70) and/or lower retainer member (72).

As shown, upper retainer member (70) is configured to rest against the top of base (24) when engaged with lower retainer member (72); while lower retainer member (72) is configured to engage with the bottom of base (24). Thus, the generally axial flanges (76, 80) of upper retainer member (70) and lower retainer member (72), respectively, are dimensioned to fit within opening (28) of base (24). It will also be appreciated that, with annular hooks (84, 82) of upper retainer member (70) and lower retainer member (72) engaged, sleeve (52) may be substantially secured relative to base (24). While bottom coil (56) is shown as being positioned between end (86) of radial flange (74) of upper retainer member (70) and sleeve (52), bottom coil (56) may be positioned elsewhere relative to upper retainer member (70), including but not limited to above or below radial flange (74) of upper retainer member (70).

Of course, the retainer members (70, 72) shown in FIG. 10 may be modified in any suitable way. For instance, any other pair of generally annular retainer members may be used. Alternatively, a pair of non-annular retainer members may be used. To the extent that each retainer member of a pair is configured to engage with the other retainer member of the pair, any alternative to annular hooks (82, 84) may be used. Still other variations will be apparent to those of ordinary skill in the art.

Figure 11:
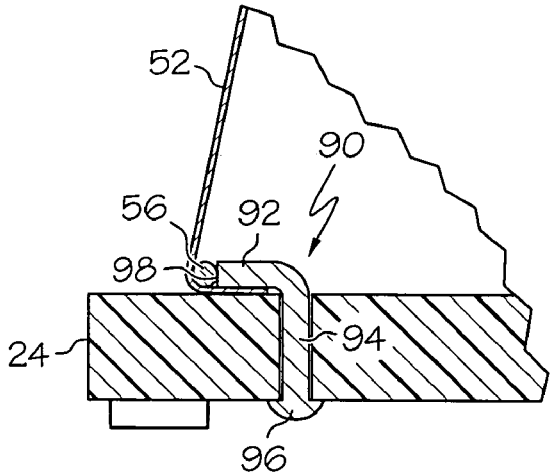
FIG. 11 depicts a partial cross-sectional view of a cone system having a retainer securing a sleeve relative to a base.

FIG. 11 shows a retainer member (90) comprising a horizontal tab (92) and a vertical tab (94). While tabs (92, 94) are shown as being generally perpendicular, any other relative positioning may be used. The vertical tab (94) of the present example terminates in a head (96). The sleeve (52) is secured to horizontal tab (92). Sleeve (52) may be substantially secured to horizontal tab (92) using, by way of example only, adhesives, fasteners, and the like. Of course, sleeve (52) may be substantially secured elsewhere to retainer member (90) and/or may be held in place by friction.

Vertical tab (94) is configured to be inserted through an opening in base (24). With vertical tab (94) inserted in base (24), head (96) is configured to restrict upward axial movement of retainer member (90), while horizontal tab (92) is configured to restrict downward axial movement of retainer member (90). It will be appreciated that, with retainer member (90) engaged with base (24), sleeve (52) may be substantially secured relative to base (24). While bottom coil (56) is shown as being positioned between end (98) of horizontal tab (92) and sleeve (52), bottom coil (56) may be positioned elsewhere relative to retainer member (90), including but not limited to above or below retainer member (90).

In one embodiment, retainer member (90) has a generally annular configuration. In one example of this embodiment, at least two retainer members (90) are used, and the material(s) forming base (24) extends between the retainer members (90), such that the material(s) forming base (24) is inside, outside, and between vertical tabs (94) of retainer members (90). In another embodiment, retainer member (90) is not annular. In yet another embodiment, head (96) is substituted with another feature to restrict upward axial movement of retainer member (90). By way of example only, any other type of flange, teeth, or the like may be used to substitute or supplement head (96). Still other configurations for retainer member (90) will be apparent to those of ordinary skill in the art. In addition, any number of retainer members (90) may be used. It will also be appreciated that retainer member(s) (90) may be substantially secured relative to base (24) at any suitable location(s) in base (24).

Figure 12A:
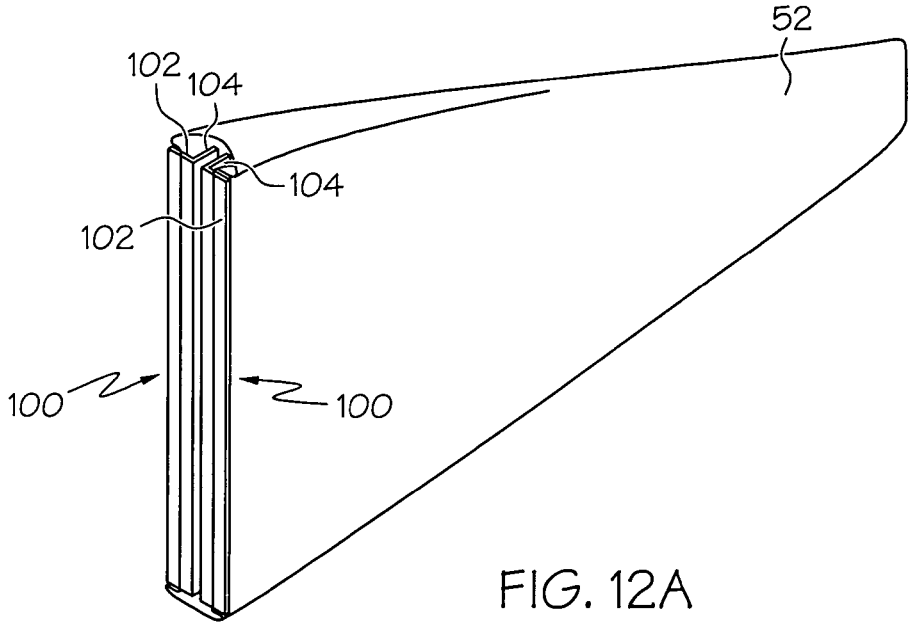
FIG. 12A depicts a perspective view of a sleeve having a pair of bow retainers.
Figure 12B:
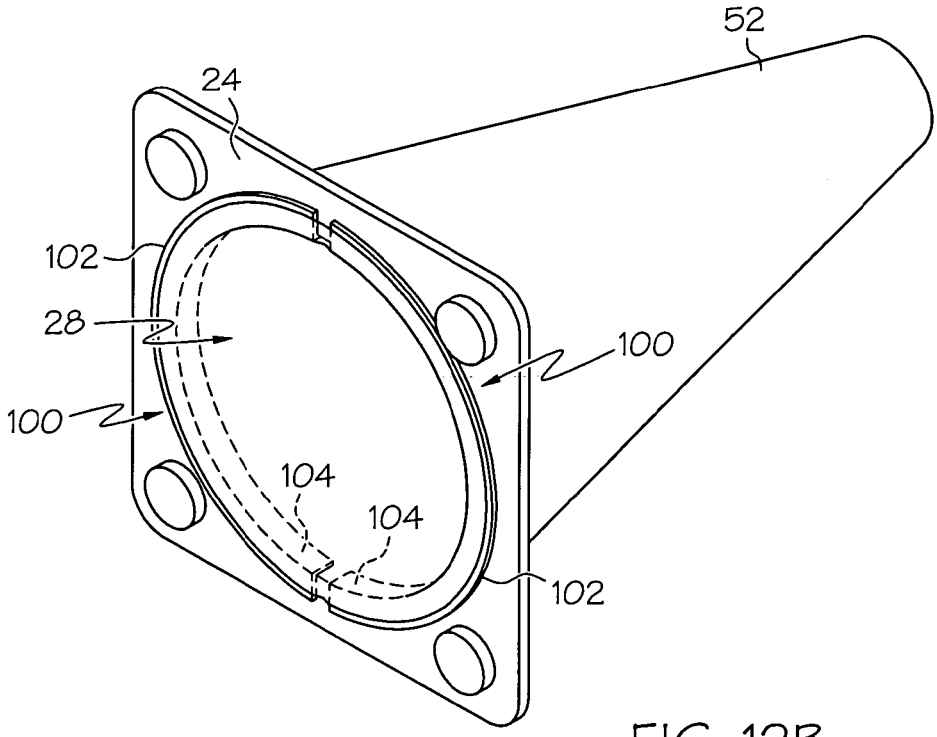
FIG. 12B depicts a perspective view of a cone system including the sleeve of FIG. 12 secured relative to a base.

FIGS. 12A and 12B show a sleeve (52) secured to a pair of bow retainers (100). Sleeve (52) may secured to bow retainers (100) in any suitable way, including but not limited to adhesives, fasteners, and the like. In one embodiment, bow retainers (100) comprise a resilient material, such as a resilient metal, plastic, or other material. Where bow retainers (100) comprise a resilient material, bow retainers (100) may be configured such that their middle portions are biased to bow outward. Alternatively, bow retainers (100) may be configured such that they are biased to stay substantially straight. Of course, bow retainers (100) could be biased in any other way. In another embodiment, bow retainers (100) comprise a malleable material, such as malleable metal, plastic, or other material, including combinations thereof. In this embodiment, bow retainers (100) may be bent outward, and will generally retain a bent shape. Still other alternative bow retainer (100) properties will be apparent to those of ordinary skill in the art.

Bow retainers (100) of the present example each comprise a horizontal flange (102) and a vertical flange (104). Sleeve (52) may be substantially secured to either flange (102, 104) of bow retainers (100). Bow retainers (100) are dimensioned to fit within the opening (28) of base (24). With bow retainers (100) positioned within opening (28) in base (24), horizontal flange (102) may restrict upward axial movement of the corresponding bow retainer (100). Bow retainers (100) may thus be used to secure sleeve (52) relative to base (24). In the embodiment shown in FIGS. 12A and 12B, bow retainers (100) each have a cross section similar to the retainer (60) shown in FIGS. 6–9. Of course, any other configuration, including but not limited to an alternative cross section, may be used. It will also be appreciated that any number of bow retainers (100) may be used.

Figure 13:
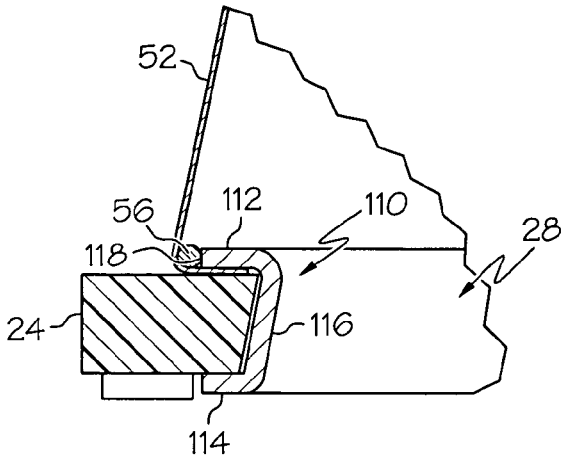
FIG. 13 depicts a partial cross-sectional view of a cone system having a pair of bow retainers.

FIG. 13 shows a bow retainer (110) having an alternative cross section to bow retainer (100) shown in FIGS. 12A and 12B. In this embodiment, bow retainer (110) comprises a pair of horizontal (112, 114) joined by a generally vertical member (116). Flanges (112, 114) and vertical member (116) thus form a generally "C"-shaped cross section. While flanges (112, 114) are shown as being generally perpendicular to vertical member (116), any other relative positioning may be used. In this embodiment, sleeve (52) is secured to the upper horizontal flange (112) of each bow retainer (110). Of course, sleeve (52) may be substantially secured to any other portion of bow retainers (110). It will also be appreciated that sleeve (52) may be substantially secured to bow retainers (110) in any suitable way, including but not limited to adhesives, fasteners, and the like. As shown, both horizontal flanges (112, 114) restrict vertical movement of bow retainers (110). Bow retainers (110) may thus be used to secure sleeve (52) relative to base (24). Other variations of bow retainers (110) will be apparent to those of ordinary skill in the art. By way of example only, the number or configuration of bow retainers (110) may be varied in any of the fashions described above with respect to bow retainers (100). In addition, while bottom coil (56) is shown as being positioned between end (118) of bow retainer (110) and sleeve (52), bottom coil (56) may be positioned elsewhere relative to bow retainer (110), including but not limited to above or below bow retainer (110).

Figure 14:
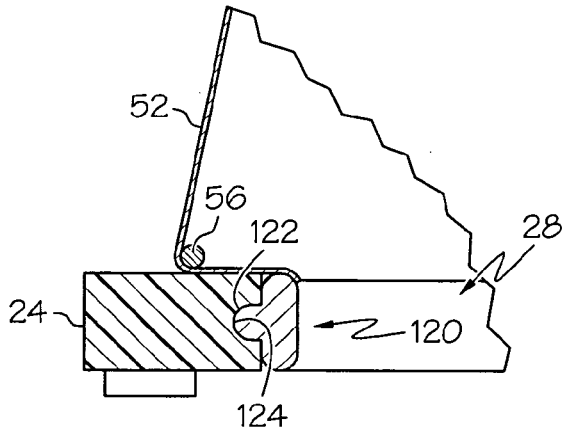
FIG. 14 depicts a-partial cross-sectional view of a cone system including an outwardly biased retainer.

FIG. 14 shows yet another embodiment of a retainer (120). In this embodiment, retainer (120) is generally annular, and has a protrusion (122) extending radially outward. While protrusion (122) is shown as extending from the middle portion of retainer (120), it will be appreciated that it may extend from the top or bottom portion of retainer, or any other portion, including combinations thereof. For instance, protrusion (120) may comprise a zig-zag or other non-linear design. Alternatively, retainer (120) may have a plurality of protrusions (122). Base (24) of the present example has an annular recess (124), which is configured to receive protrusion (122). It will be appreciated that, to the extent that protrusion (122) may be varied, so may recess (124). Sleeve (52) is secured to retainer (120). Sleeve (52) may be substantially secured to retainer (120) in any suitable way, including but not limited to adhesives, fasteners, and the like. In this embodiment, engagement of protrusion (122) with recess (124) generally restricts axial movement of retainer (120). Retainer (120) may thus be used to secure sleeve (52) relative to base (24). Of course, retainer (120) may be varied in any suitable way.

In another alternative embodiment, retainer (120) is configured to fit on the outside of base (24), such as the outer perimeter of base. For instance, protrusion (122) may extend inward to mate with a corresponding recess formed in the outer perimeter of base (24). Still other variations of retainer (120) and base (24) will be apparent to those of ordinary skill in the art.

Figure 15:
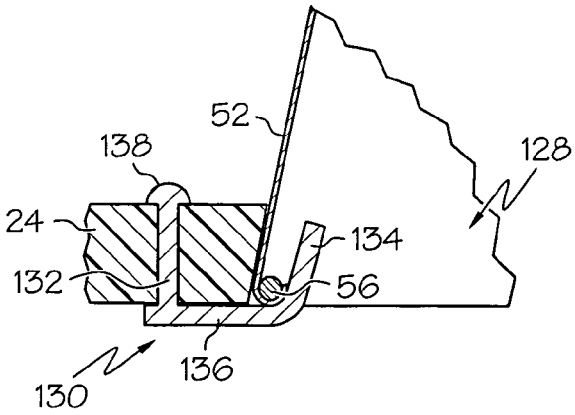
FIG. 15 depicts a partial cross-sectional view of a cone system including a retainer engaged with a spring coil.

FIG. 15 shows a retainer (130) comprising a pair of generally vertical tabs (132, 134) joined by a generally horizontal member (136). Tabs (132, 134) and horizontal member (136) thus form a generally "U"-shaped cross section. While tabs (132, 134) are shown as being generally perpendicular to horizontal member (136), any other relative positioning may be used. As shown, the outer vertical tab (132) terminates in a head (138), which is similar to the head (96) shown in FIG. 11. The sleeve (52) is secured to horizontal member (136) and the inner vertical tab (134). Of course, sleeve (52) may be substantially secured elsewhere to retainer (130). Sleeve (52) may be substantially secured to horizontal member (136) and/or inner vertical tab (134) using, by way of example only, adhesives, fasteners, and the like. Alternatively, sleeve (52) may be held in place by friction alone. With outer vertical tab (132) inserted in base (24), head (138) is configured to restrict downward axial movement of retainer member (130), while horizontal member (136) is configured to restrict upward axial movement of retainer member (130). It will be appreciated that, with retainer member (130) engaged with base (24), sleeve (52) may be substantially secured relative to base (24). While bottom coil (56) is shown as being positioned between inner vertical member (134) and base (24), bottom coil (56) may be positioned elsewhere relative to retainer member (130) and/or base (24).

In one embodiment, retainer member (130) has a generally annular configuration. In one example of this embodiment, at least two retainer members (130) are used, and the material(s) forming base (24) extends between the retainer members (130), such that the material(s) forming base (24) is inside, outside, and between retainer members (130). In another embodiment, retainer member (130) is not annular. In yet another embodiment, head (138) is substituted with another feature to restrict upward axial movement of retainer member (130). By way of example only, any other type of flange, teeth, or the like may be used to substitute or supplement head (138). Still other configurations for retainer member (130) will be apparent to those of ordinary skill in the art. In addition, any number of retainer members (130) may be used. It will also be appreciated that retainer member(s) (130) may be substantially secured relative to base (24) at any suitable location(s) in base (24).

Figure 16:
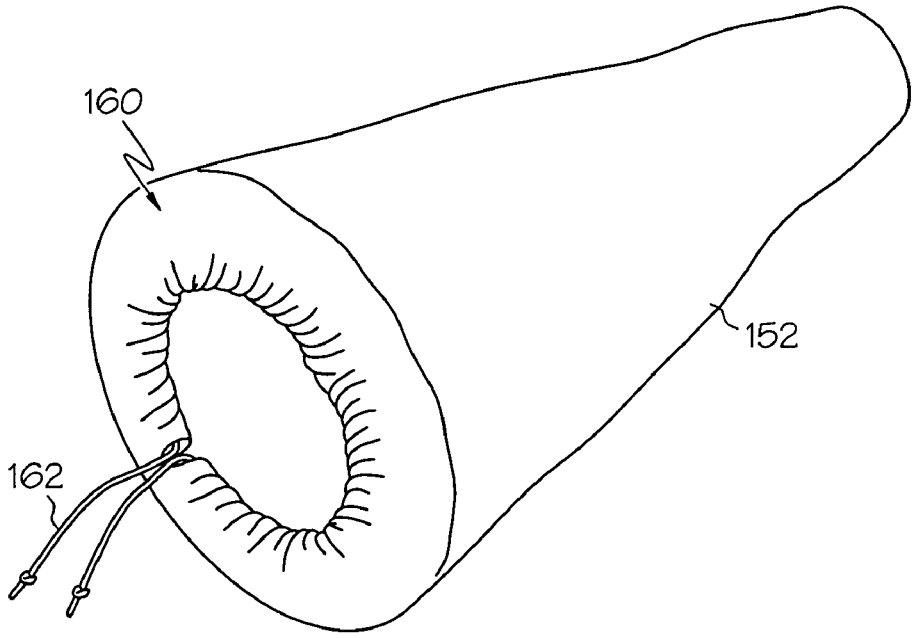
FIG. 16 depicts perspective view of a sleeve having a cinch.

FIGS. 16–21 illustrate one of many ways in which sleeve (52) may be modified. In this embodiment, a sleeve (152) has a cinched portion (160). In the present example, cinched portion (160) is provided by a drawstring (162). Of course, cinched portion (160) may be provided in any other way, including but not limited to an elastomeric member or the like. Of course, as used herein, the term "cinched" and its variants should not be read as requiring an act of cinching per se. Indeed, it will be appreciated that a sleeve (152) may be formed having a portion that is substantially similar in appearance and/or function to a portion that has actually undergone an act of cinching. FIG. 16 shows a sleeve (152) having an exemplary cinched portion (160), without a base. Of course, a given cinched portion may vary greatly from the exemplary cinched portion illustrated in FIG. 16.

Figure 17:
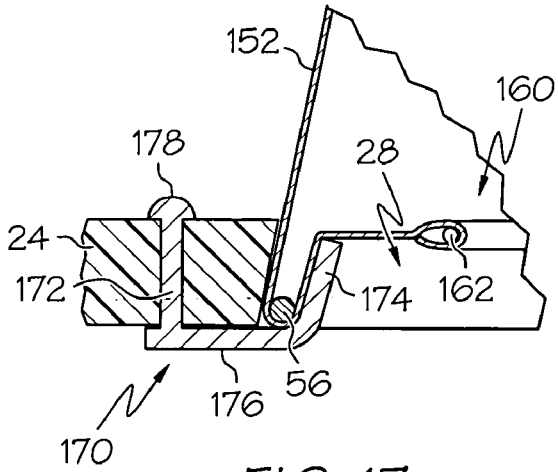
FIG. 17 depicts a partial cross-sectional view of a cone system including a retainer and the sleeve of FIG. 16.

In FIG. 17, a retainer (170) is used to secure sleeve (152) relative to base (24). In this embodiment, retainer (170) is similar to the retainer (130) shown in FIG. 15. Retainer (170) comprises a pair of generally vertical tabs (172, 174) joined by a generally horizontal member (176). Tabs (172, 174) and horizontal member (176) thus form a generally "U"-shaped cross section. While tabs (172, 174) are shown as being generally perpendicular to horizontal member (176), any other relative positioning may be used. As shown, the outer vertical tab (172) terminates in a head (178), which is similar to the heads (96, 138) shown in FIGS. 11 and 15. In the present example, sleeve (152) is not secured to retainer (170). However, if desired, sleeve (152) may be substantially secured to any portion of retainer (170) using adhesives, fasteners, or the like. With outer vertical tab (172) inserted in base (24), head (178) is configured to restrict downward axial movement of retainer member (170), while horizontal member (176) is configured to restrict upward axial movement of retainer member (170). It will be appreciated that, with retainer member (170) engaged with base (24), sleeve (152) may be substantially secured relative to base (24). While bottom coil (56) is shown as being positioned between inner vertical member (174) and base (24), bottom coil (56) may be positioned elsewhere relative to retainer member (170) and/or base (24).

In one embodiment, retainer member (170) has a generally annular configuration. In one example of this embodiment, at least two retainer members (170) are used, and the material(s) forming base (24) extends between the retainer members (170), such that the material(s) forming base (24) is inside, outside, and between retainer members (170). In another embodiment, retainer member (170) is not annular. In yet another embodiment, head (178) is substituted with another feature to restrict upward axial movement of retainer member (170). By way of example only, any other type of flange, teeth, or the like may be used to substitute or supplement head (178). Still other configurations for retainer member (170) will be apparent to those of ordinary skill in the art. In addition, any number of retainer members (170) may be used. It will also be appreciated that retainer member(s) (170) may be substantially secured relative to base (24) at any suitable location(s) in base (24).

Figure 18:
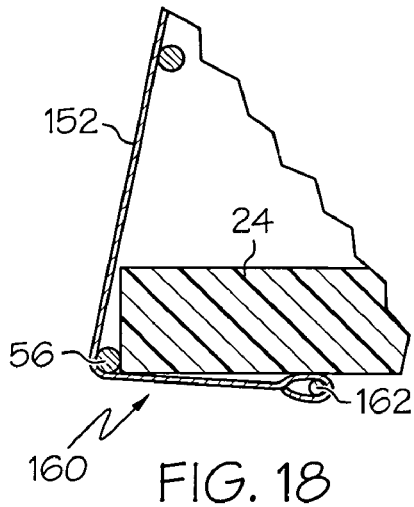
FIG. 18 depicts a partial cross-sectional view of a cone system including the sleeve of FIG. 16.

In another embodiment, cinched portion (160) acts as a retainer. In other words, a cinched portion (160) may be used to restrict certain movement of sleeve (152) relative to base (24) without additional components. An example of this embodiment is shown in FIG. 18, in which bottom coil (56) and sleeve (152) are both positioned outside the outer perimeter of base (24). In particular, bottom coil (56) is positioned between sleeve (152) and outer perimeter of base (24). Alternatively, bottom coil (56) may be positioned above base (24), below base (24), within the opening (28) of base (24), or elsewhere. Other configurations in which cinched portion (160) may be used to provide a retainer or otherwise substantially secure sleeve (152) relative to base (24) will be apparent to those of ordinary skill in the art.

Figure 19:
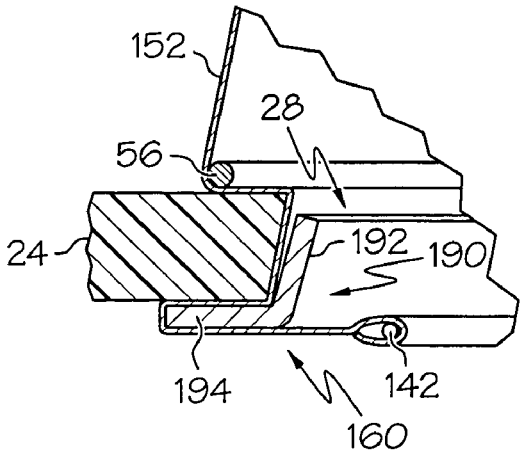
FIG. 19 depicts a partial cross-sectional view of a cone system including a retainer having a generally "L"-shaped cross section and the sleeve of FIG. 16.

In FIG. 19, a retainer (190) comprises a vertical tab (192) and a horizontal tab (194), which are generally perpendicular relative one another. Of course, any other relative positions for tabs (192, 194) may be used. Retainer (190) has a generally annular configuration. Alternatively, retainer (190) may be non-annular. In this example, retainer (190) is dimensioned to fit within opening (28) of base (24), such that vertical tab (192) is positioned within opening (28) while horizontal tab (194) is positioned adjacent opening (28) at the bottom of base (24). Sleeve (152) is positioned such that it passes between bottom coil (56) and base (24), between retainer (190) and base (24), then radially inward beneath retainer (190). In one embodiment, retainer (190) is configured such that it would secure sleeve (152) relative to base (24) even if sleeve (152) lacked cinched portion (160). In another embodiment, retainer (190) is configured such that it works in conjunction with cinched portion (160). Retainer (190) may be resilient, rigid, or have any other properties. Other variations of retainer (190), including ways in which it may interact with cinched portion (160), will be apparent to those of ordinary skill in the art.

Figure 20:
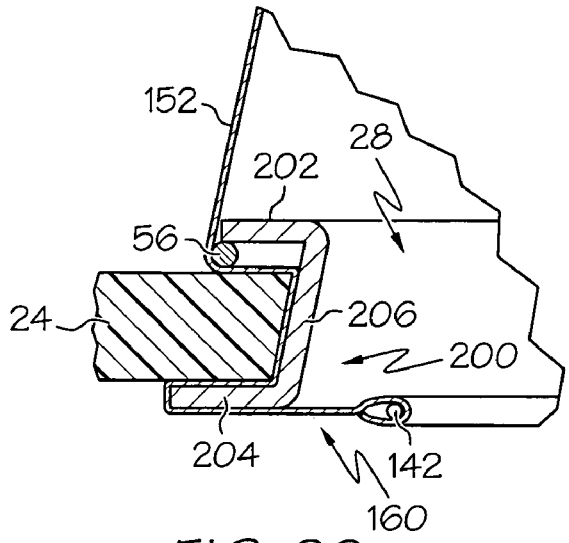
FIG. 20 depicts a partial cross-sectional view of a cone system including a retainer having a generally "U"-shaped cross section and the sleeve of FIG. 16, with the cinch of the sleeve below the retainer.

FIG. 20 shows a retainer (200) comprising a pair of horizontal tabs (202, 204) joined by a generally vertical member (206). In the present example, retainer (200) is generally annular. Alternatively, retainer (200) may be non-annular. Tabs (202, 204) and vertical member (206) thus form a generally "C"-shaped cross section. While tabs (202, 204) are shown as being generally perpendicular to vertical member (206), it will be appreciated that any other relative positioning may be used. As shown, bottom coil (56) is positioned under horizontal tab (202). Of course, bottom coil (56) may be positioned elsewhere with respect to retainer (200). In this example, sleeve (152) passes under bottom coil (56), between vertical member (206) and base (24), between horizontal tab (204) and base (24), then radially inward beneath retainer (200). Sleeve (152) is thus substantially secured relative to base (24), with cinched portion (160) being positioned below retainer (200). Other variations of retainer (200), including but not limited to ways in which retainer (200) may interact with sleeve (152), will be apparent to those of ordinary skill in the art.

Figure 21:
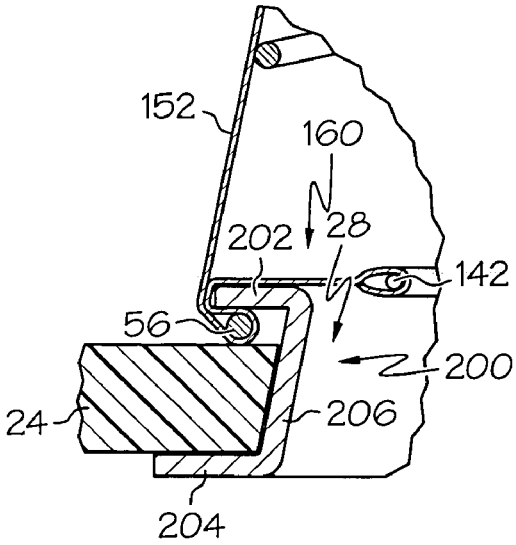
FIG. 21 depicts a partial cross-sectional view of a cone system including a retainer having a generally "U"-shaped cross section and the sleeve of FIG. 16, with the cinch of the sleeve above the retainer.

One variation of interaction between retainer (200) and sleeve (152) is illustrated in FIG. 21. The embodiment depicted in FIG. 21 is substantially similar to the embodiment depicted in FIG. 20, with the exception of the path followed by sleeve (152). As shown, sleeve (152) passes beneath and around bottom coil (56), then above horizontal tab (202) radially inward. Sleeve (152) is thus substantially secured relative to base (24), with cinched portion (160) being positioned above retainer.

While FIGS. 17–21 depict several embodiments in which a sleeve (152) having a cinched portion (160) may be substantially secured relative to a base (24), it will be appreciated that each of those embodiments may be varied substantially. For instance, such embodiments may be used with a sleeve (52) lacking a cinched portion (160) It will also be appreciated that a sleeve (152) having a cinched portion (160) may be incorporated into the remainder of the embodiments depicted and described herein.

FIGS. 22–25 depict several embodiments in which a sleeve (52) may be substantially secured relative to a base (24) through a pinching or clamping effect produced by a retainer. In one version of these embodiments, the sleeve (52) is not secured to the retainers with an adhesive or fasteners, but is instead held in place by friction or other products of pinching or clamping. In another version of these embodiments, the sleeve is secured to the retainers, such as by adhesives, fasteners, or the like. Other variations will be apparent to those of ordinary skill in the art.

Figure 22:
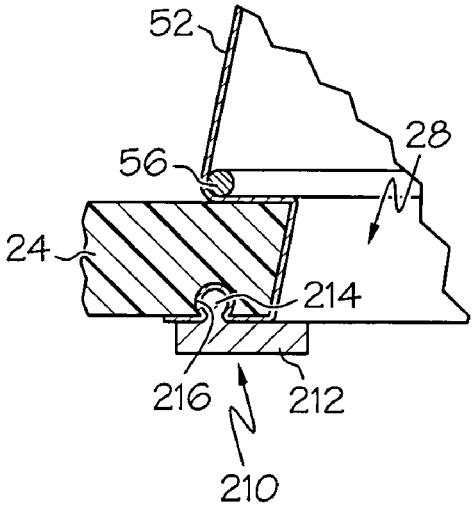
FIG. 22 depicts a partial cross-sectional view of a cone system including a retainer securing a sleeve relative to the bottom of the base.

In FIG. 22, a retainer (210) comprises a horizontal member (212) having a protrusion (214) protruding vertically therefrom. The bottom of base (24) has an upwardly extending recess (216) having a shape corresponding to the shape of protrusion (214). In other words, protrusion (214) is configured to fit into recess (216), such as in a manner similar to the fit between jigsaw puzzle pieces. Of course, protrusion (214) may fit into recess (216) in any other suitable way. In this example, sleeve (52) may be positioned between retainer (210) and base (24), such that a portion of sleeve (52) is pinched or clamped into recess (216) by protrusion (214). Sleeve (52) may thus be substantially secured relative to base (24). It will be appreciated that this embodiment may be varied in a number of ways. For instance, the shapes of protrusion (214) and recess (216) may be varied greatly. In addition, the position of recess (216) may vary. By way of example only, recess (216) may be located inside the opening (28) of base (24), on top of base (24), about the outer perimeter of base (24), or elsewhere in base (24). In addition, retainer (210) may comprise an annular member, or may by non-annular. Any number of retainers (210) may be used. Still other variations of retainer (210) and/or recess (216) will be apparent to those of ordinary skill in the art.

Figure 23:
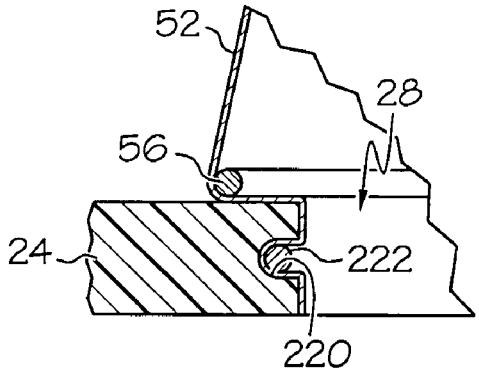
FIG. 23 depicts a partial cross-sectional view of a cone system including a retainer securing a sleeve relative to the opening of the base.

In FIG. 23, an inward annular recess (220) is formed within opening (28) of base (24). A retainer (222) is configured to fit within recess (220). As shown, sleeve (52) may be positioned within recess (220), between retainer (222) and recess (220). In this example, retainer (222) is resiliently urged outward, such that it pinches or clamps the adjacent portion of sleeve (52) against the wall of base (24) defining recess (220), thereby substantially securing sleeve (52) relative to base (24). Alternatively, or additionally, retainer (222) may pinch or clamp an adjacent portion of sleeve (52) into recess through an interference fit. Such interference may be provided by the relative dimensions of retainer (222) and recess (220) alone, and/or by those components combined with sleeve (52). In one embodiment, retainer (222) comprises a metal ring. In yet another embodiment, the bottom coil (56) is used as retainer (222), and is therefore positioned within recess (220). Of course, recess (220) and/or retainer (222) may be varied in any other way. By way of example only, recess (220) may be positioned in the outer perimeter of base (24), in the top of base (24), in the bottom of base (24), or elsewhere in base (24).

Figure 24:
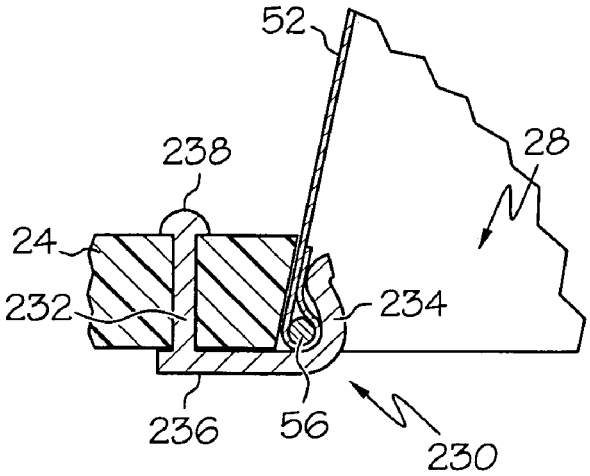
FIG. 24 depicts a partial cross-sectional view of a cone system including a retainer securing a sleeve and a spring coil relative to the opening of the base.

FIG. 24 depicts an embodiment where a retainer (230) is similar to the retainers (130, 170) shown in FIGS. 15 and 17. In this embodiment, retainer (230) comprises a pair of generally vertical tabs (232, 234) joined by a generally horizontal member (236). Tabs (232, 234) and horizontal member (236) thus form a generally "U"-shaped cross section. While tabs (232, 234) are shown as being generally perpendicular to horizontal member (236), any other relative positioning may be used. As shown, the outer vertical tab (232) terminates in a head (238), which is similar to the heads (96, 138, 178) shown in FIGS. 11, 15, and 17. With outer vertical tab (232) inserted in base (24), head (238) is configured to restrict downward axial movement of retainer member (230), while horizontal member (236) is configured to restrict upward axial movement of retainer member (230).

In the present example, inner vertical tab (234) is resiliently urged toward outer vertical tab (232). Accordingly, with bottom coil (56) and sleeve (52) positioned between base (24) and inner vertical tab (234), inner vertical tab (234) is configured to pinch or clamp sleeve (52) against base (24), thereby substantially securing sleeve (52) relative to base (24). While two layers of sleeve (52) are shown as being pinched or clamped by retainer (230) against base (24), it will be appreciated that any number of layers of sleeve (52) may be pinched or clamped by retainer (230) against base (24). In addition, bottom coil (56) may be positioned above inner vertical tab (234) rather than between inner vertical tab (234) and base (24), or may be positioned elsewhere.

In one embodiment, retainer member (230) has a generally annular configuration. In one example of this embodiment, at least two retainer members (230) are used, and the material(s) forming base (24) extends between the retainer members (230), such that the material(s) forming base (24) is inside, outside, and between retainer members (230). In another embodiment, retainer member (230) is not annular. In yet another embodiment, head (238) is substituted with another feature to restrict downward movement of retainer member (230). By way of example only, any other type of flange, teeth, or the like may be used to substitute or supplement head (238). Still other configurations for retainer member (230) will be apparent to those of ordinary skill in the art. In addition, any number of retainer members (230) may be used. It will also be appreciated that retainer member(s) (230) may be substantially secured relative to base (24) at any suitable location(s) in base (24), including but not limited to the outer perimeter of base (24).

Figure 25:
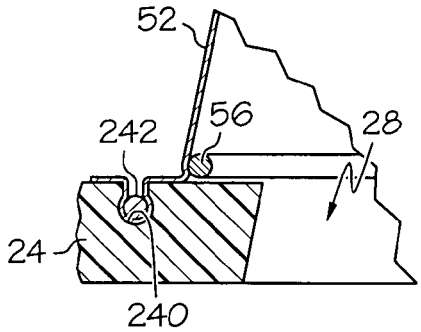
FIG. 25 depicts a partial cross-sectional view of a cone system including a retainer securing a sleeve relative to the top of the base.

In FIG. 25, an inward annular recess (240) is formed within the top of base (24). It will be appreciated that this embodiment has many similarities to the embodiment depicted in FIG. 23. A retainer (242) is configured to fit within recess (240). As shown, sleeve (52) may be positioned within recess (240), between retainer (242) and recess (240). In this example, retainer (242) is resiliently urged outward, such that it pinches or clamps the adjacent portion of sleeve (52) against the wall of base (24) defining recess (240), thereby substantially securing sleeve (52) relative to base (24). Alternatively, or additionally, retainer (242) may pinch or clamp an adjacent portion of sleeve (52) into recess through an interference fit. Such interference may be provided by the relative dimensions of retainer (242) and recess (240) alone, and/or by those components combined with sleeve (52). In one embodiment, retainer (242) comprises a metal ring. In yet another embodiment, the bottom coil (56) is used as retainer (242), and is therefore positioned within recess (240). Of course, recess (240) and/or retainer (242) may be varied in any other way. By way of example only, recess (240) may be positioned on the bottom of base (24), in the opening (28) of base (24), in the outer perimeter of base (24), or elsewhere in base (24).

Figure 26:
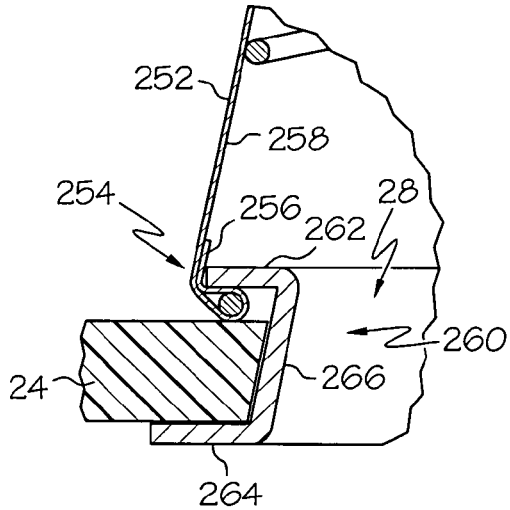
FIG. 26 depicts a partial cross-sectional view of a cone system including a retainer having a generally "U"-shaped cross section securing a sleeve having a pocket portion and a spring coil relative to the top of the base.
Figure 27:
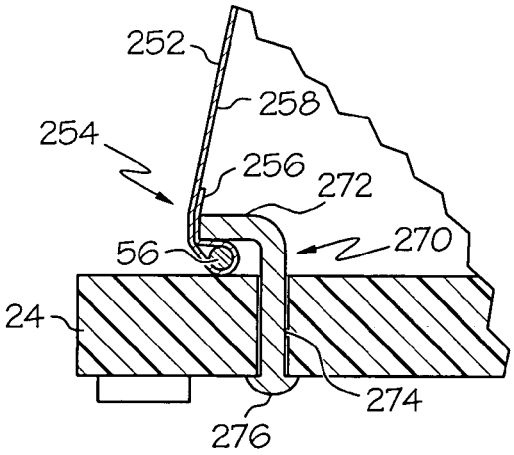
FIG. 27 depicts a partial cross-sectional view of a cone system including a retainer having a generally "L"-shaped cross section securing a sleeve having a pocket portion and a spring coil relative to the top of the base.
Figure 28:
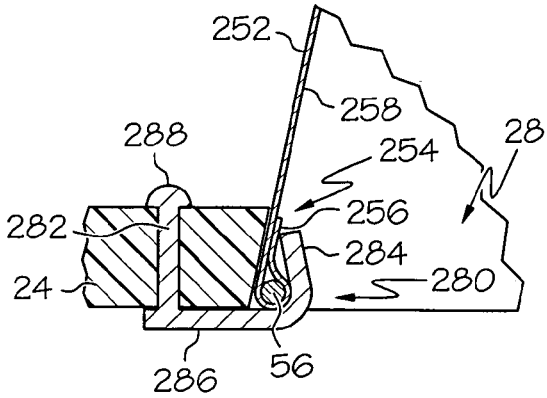
FIG. 28 depicts a partial cross-sectional view of a cone system including a retainer having a generally "L"-shaped cross section securing a sleeve having a pocket portion and a spring coil relative to the opening of the base.

In the embodiments depicted in FIGS. 26–28, a sleeve (252) has a pocket region (254) formed at one end. For instance, where sleeve (252) has a wide opening and a narrow opening, pocket region (254) may be formed at its wide opening. Pocket region (254) may be formed in any suitable way, such as by folding up the end (256) of sleeve (252) and securing it to the inner surface (258) of sleeve (252). End (256) may be substantially secured to inner surface (258) using any suitable technique, including but not limited to using adhesives, fasteners, stitching, or any other technique. Other ways in which pocket region (254) may be formed will be apparent to those of ordinary skill in the art. Pocket region (254) of the present example is configured to receive at least a portion of bottom coil (56). It will be appreciated that the configuration of pocket region (254) may be varied in any suitable way. By way of example only, pocket region (254) may be configured to receive a substantial portion of spring (54). Pocket region (254) may further comprise one or more openings for inserting and/or removing spring (54) or other components. It will also be appreciated that a sleeve (252) having a pocket region (254) may be used in any of the embodiments depicted in FIGS. 1–25, including variations thereof. Similarly, the previously described sleeves (52, 152), including variations thereof, may be used in any of the embodiments shown in FIGS. 26–28.

In FIG. 26, a retainer (260) comprises a pair of horizontal tabs (262, 264) joined by a generally vertical member (266). It will be appreciated that this retainer (260) is similar to the retainers (110, 200) shown in FIGS. 13, 20, and 21. Tabs (262, 264) and vertical member (266) thus form a generally "C"-shaped cross section. While tabs (262, 264) are shown as being generally perpendicular relative to vertical member (266), it will be appreciated that any other relative positioning may be used. As shown, bottom coil (56), including a portion of pocket portion (254) is positioned between horizontal tab (262) and the top of base (24). Of course, bottom coil (56) and/or pocket portion (254) may be positioned elsewhere with respect to retainer (260). For instance, pocket portion (254) may be positioned between vertical member (266) and base (24), between horizontal tab (264) and base (24), or elsewhere. Other variations of retainer (260), including but not limited to ways in which retainer (260) may interact with pocket portion (254) or other portions of sleeve (252), will be apparent to those of ordinary skill in the art.

In the present example, retainer (260) has a generally annular configuration. In another embodiment, retainer member (260) is not annular. Still other configurations for retainer member (260) will be apparent to those of ordinary skill in the art. In addition, any number of retainer members (260) may be used. It will also be appreciated that retainer member(s) (260) may be substantially secured relative to base (24) at any suitable location(s) in or on base (24). By way of example only, a retainer member (260) may be substantially secured to the outer perimeter of base (24) rather than within opening (28).

In FIG. 27, a retainer (270) comprises a horizontal tab (272) and a vertical tab (274). It will be appreciated that retainer (270) has a configuration similar to the retainer (90) shown in FIG. 11. While tabs (272, 274) are shown as being generally perpendicular, any other relative positioning may be used. The vertical tab (274) of the present example terminates in a head (276). Head (276) is similar to the heads (96, 138, 178, 238) shown in FIGS. 11, 15, 17, and 24. As shown, bottom coil (56), including a portion of pocket portion (254) is positioned between horizontal tab (272) and the top of base (24). Of course, bottom coil (56) and/or pocket portion (254) may be positioned elsewhere with respect to retainer (270). Vertical tab (274) is configured to be inserted through an opening in base (24). With vertical tab (274) inserted in base (24), head (276) is configured to restrict upward axial movement of retainer member (270), while horizontal tab (272) is configured to restrict downward axial movement of retainer member (270). It will be appreciated that, with retainer member (270) engaged with base (24), sleeve (252) may be substantially secured relative to base (24).

In one embodiment, retainer member (270) has a generally annular configuration. In another embodiment, retainer member (270) is not annular, and is generally "L"-shaped. In yet another embodiment, head (276) is substituted with another feature to restrict upward axial movement of retainer member (270). By way of example only, any other type of flange, teeth, or the like may be used to substitute or supplement head (276). Still other configurations for retainer member (270) will be apparent to those of ordinary skill in the art. In addition, any number of retainer members (270) may be used. It will also be appreciated that retainer member(s) (270) may be substantially secured relative to base (24) at any suitable location(s) in base (24).

FIG. 28 shows a retainer (280) comprising a pair of generally vertical tabs (282, 284) joined by a generally horizontal member (286). Retainer (280) is similar to retainers (130, 170, 230) shown in FIGS. 15, 17, and 24. Tabs (282, 284) and horizontal member (286) thus form a generally "U"-shaped cross section. While tabs (282, 284) are shown as being generally perpendicular to horizontal member (286), any other relative positioning may be used. As shown, the outer vertical tab (282) terminates in a head (288), which is similar to the heads (96, 138, 178, 238, 276) shown in FIGS. 11, 15, 17, 24, and 27. As shown, bottom coil (56), including a portion of pocket portion (254) is positioned between horizontal member (286) and the top of base (24). Of course, bottom coil (56) and/or pocket portion (254) may be positioned elsewhere with respect to retainer (280). With outer vertical tab (282) inserted in base (24), head (288) is configured to restrict downward axial movement of retainer member (280), while horizontal member (286) is configured to restrict upward axial movement of retainer member (280). It will be appreciated that, with retainer member (280) engaged with base (24), sleeve (252) may be substantially secured relative to base (24).

In one embodiment, retainer member (280) has a generally annular configuration. In one example of this embodiment, at least two retainer members (280) are used, and the material(s) forming base (24) extends between the retainer members (280), such that the material(s) forming base (24) is inside, outside, and between retainer members (280). In another embodiment, retainer member (280) is not annular. In yet another embodiment, head (288) is substituted with another feature to restrict upward axial movement of retainer member (280). By way of example only, any other type of flange, teeth, or the like may be used to substitute or supplement head (288). Still other configurations for retainer member (280) will be apparent to those of ordinary skill in the art. In addition, any number of retainer members (280) may be used. It will also be appreciated that retainer member(s) (280) may be substantially secured relative to base (24) at any suitable location(s) in base (24).

To the extent that the foregoing embodiments are applied to traffic cones, it will be appreciated that the embodiments may be applied to any type of traffic cones, including but not limited to what is well known in the industry as the "wide cone design." To the extent that embodiments are employed to produce cones, it will be appreciated that such cones may be stacked in a manner similar to conventional traffic cones, and/or such cones may be compressed to reduce the height to approximately that of the base. While many of the foregoing embodiments have been discussed in the context of traffic cones, it will be appreciated that embodiments may also be applied to any other type of cone. In addition, embodiments may include non-cone shapes and configurations. It will also be appreciated that embodiments may provide a cone whose components may be replaced with relative ease. Still other uses, features, and variations will be apparent to those of ordinary skill in the art.

Having shown and described various embodiments and concepts of the invention, further adaptations of the methods and systems described herein can be accomplished by appropriate modifications by one of ordinary skill in the art without departing from the scope of the invention. Several of such potential alternatives, modifications, and variations have been mentioned, and others will be apparent to those skilled in the art in light of the foregoing teachings. Accordingly, the invention is intended to embrace all such alternatives, modifications and variations as may fall within the spirit and scope of the appended claims and is understood not to be limited to the details of structure and operation shown and described in the specification and drawings.

The invention claimed is:

1. A cone shaped delineator, comprising:

(a) a base having a top side, a bottom side, and an opening extending from the top side to the bottom side, wherein the opening of the base has a first radius;

(b) a conical sleeve;

(c) a resilient member inserted into the sleeve;

(d) an annular retainer, wherein the annular retainer has an outer perimeter defined by a second radius, wherein the sleeve is permanently secured to the annular retainer, wherein the second radius is greater than the first radius, wherein the retainer is configured to secure movement of the sleeve relative to the base; and (e) wherein the annular retainer comprises an axial flange and a radial flange having an outer perimeter, wherein the outer perimeter of the radial flange is defined by the second radius and contacts the bottom of the base, wherein the axial flange is positioned within the opening of the base and aligns with the opening of the base.

2. A method of making a traffic cone, comprising:

(a) providing a base having an opening;

(b) providing a sleeve;

(c) providing a resilient member;

(d) providing an annular retainer having an axial flange and radial flange;

(e) permanently securing the sleeve to the annular retainer;

(f) inserting the sleeve through the opening of the base until the axial flange aligns with the opening and until the radial flange contacts the bottom of the base; and (g) temporarily reduce the resilient member in order to pass through the opening of the base and into the inside of the sleeve; then (h) allowing the resilient member to expand, locking itself inside of the sleeve and on top of the base.

* * * * *